US012570918B2

(12) United States Patent
Kumar

(10) Patent No.: US 12,570,918 B2
(45) Date of Patent: Mar. 10, 2026

(54) HIGH PERFORMANCE GREASE COMPOSITIONS

(71) Applicant: CHEVRON U.S.A. INC., San Ramon, CA (US)

(72) Inventor: Anoop Kumar, Martinez, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 18/166,531

(22) Filed: Feb. 9, 2023

(65) Prior Publication Data

US 2023/0250356 A1 Aug. 10, 2023

Related U.S. Application Data

(60) Provisional application No. 63/308,959, filed on Feb. 10, 2022.

(51) Int. Cl.
*C10M 169/00* (2006.01)
*C10M 115/10* (2006.01)
(Continued)

(52) U.S. Cl.
CPC ..... *C10M 169/00* (2013.01); *C10M 115/10* (2013.01); *C10M 125/10* (2013.01); *C10M 129/32* (2013.01); *C10M 129/44* (2013.01); *C10M 141/02* (2013.01); *C10M 159/005* (2013.01); *C10M 163/00* (2013.01); *C10M 2201/062* (2013.01); *C10M 2203/003* (2013.01); *C10M 2207/122* (2013.01);
(Continued)

(58) Field of Classification Search
CPC ..... C10M 169/00; C10M 115/10; C10M 125/10; C10M 129/32; C10M 129/44; C10M 141/02; C10M 159/005; C10M 163/00; C10M 2201/062; C10M 2203/003; C10M 2207/122; C10M 2207/128; C10M 2219/0466; C10M 121/04; C10M 2201/066; C10M 2215/066; C10M 2219/046; C10N 2020/06; C10N 2030/44; C10N 2050/10; C10N 2030/06; C10N 2030/10; C10N 2030/40; C10N 2070/00
See application file for complete search history.

(56) References Cited

U.S. PATENT DOCUMENTS

| | | | |
|---|---|---|---|
| 4,560,489 | A | 12/1985 | Muir et al. |
| 5,126,062 | A | 6/1992 | Barnes |
| 5,308,514 | A | 5/1994 | Olson et al. |
| 5,338,467 | A | 8/1994 | Olson et al. |
| 8,563,488 | B2 | 10/2013 | Sivik et al. |

(Continued)

FOREIGN PATENT DOCUMENTS

| | | |
|---|---|---|
| EP | 2773590 | 9/2014 |

OTHER PUBLICATIONS

Wang, H., et al., Tribological behavior of layered double hydroxides with various chemical compositions and morphologies as grease additives, Tsinghua University Press, Mar. 3, 2020, 11 pages.

(Continued)

*Primary Examiner* — Cephia D Toomer
(74) *Attorney, Agent, or Firm* — HUNTON ANDREWS KURTH LLP

(57) ABSTRACT

This invention relates to overbased calcium sulfonate complex grease compositions prepared without boric acid and alcohol promotors containing anti-wear, anti-friction, thermal & oxidation stability additives.

19 Claims, 5 Drawing Sheets

(51) Int. Cl.

| | |
|---|---|
| ***C10M 125/10*** | (2006.01) |
| ***C10M 129/32*** | (2006.01) |
| ***C10M 129/44*** | (2006.01) |
| ***C10M 141/02*** | (2006.01) |
| ***C10M 159/00*** | (2006.01) |
| ***C10M 163/00*** | (2006.01) |
| *C10N 20/06* | (2006.01) |
| *C10N 30/00* | (2006.01) |
| *C10N 50/10* | (2006.01) |

(52) U.S. Cl.
CPC ..... *C10M 2207/128* (2013.01); *C10M 2219/0466* (2013.01); *C10N 2020/06* (2013.01); *C10N 2030/44* (2020.05); *C10N 2050/10* (2013.01)

(56) References Cited

U.S. PATENT DOCUMENTS

| | | | | |
|---|---|---|---|---|
| 10,590,362 | B2 * | 3/2020 | Bardin | C10M 121/04 |
| 11,041,133 | B2 | 6/2021 | Baralt et al. | |
| 2005/0215442 | A1 | 9/2005 | Sivik et al. | |
| 2021/0171855 | A1 | 6/2021 | Genet et al. | |

OTHER PUBLICATIONS

International Searching Authority, issued on May 4, 2023, during the prosecution of International Application No. PCT/IB2023/051148.

Written Opinion of the International Searching Authority, issued on May 4, 2023, during the prosecution of International Application No. PCT/IB2023/051148.

* cited by examiner

HIGH PERFORMANCE GREASE COMPOSITIONS

FIELD OF THE INVENTION

This invention relates to the development of grease compositions and processes thereof based on overbased calcium sulfonate complex grease prepared without boric acid and without the use of any alcohol-based promotors.

BACKGROUND OF THE INVENTION

Overbased calcium sulfonate greases have been an established grease in the state of the art. U.S. Pat. No. 9,273,265 teaches that a known process for making such greases is a two-step process involving the steps of "promotion" and "conversion." Typically the first step ("promotion") is to react a stoichiometric excess amount of calcium oxide (CO) or calcium hydroxide (Ca(OH)2) as the base source with an alkyl benzene sulfonic acid, carbon dioxide (CO2), and with other components to produce an oil-soluble overbased calcium sulfonate with amorphous calcium carbonate dispersed therein. These overbased oil-soluble calcium sulfonates are typically clear and bright and have Newtonian rheology. In some cases, they may be slightly turbid, but such variations do not prevent their use in preparing overbased calcium sulfonate greases. Typically the second step ("conversion") is to add a converting agent or agents, such as propylene glycol, iso-propyl alcohol, water, formic acid or acetic acid, to the product of the promotion step, along with a suitable base oil such as mineral oil), to convert the amorphous calcium carbonate to a very finely divided dispersion of crystalline calcium carbonate. Because an excess of calcium hydroxide or calcium oxide is used to achieve overbasing, a small amount of residual calcium oxide or calcium hydroxide may also be present and will be dispersed. The crystalline form of the calcium carbonate is preferably calcite. This extremely finely divided calcium carbonate, also known as a colloidal dispersion, interacts with the calcium sulfonate to form a grease-like consistency. Such overbased calcium sulfonate greases produced through the two-step process have come to be known as "simple calcium sulfonate greases" and are disclosed, for example, in U.S. Pat. Nos. 3,242,079; 3,372,115; 3,376,222, 3,377,283; and 3,492,231.

Calcium sulfonate (Ca-sulfonate) greases have recently been emerging as potential alternate to lithium greases in many industrial applications. The advantages of Ca-sulfonate greases is their superior high performance characteristics over lithium complex greases in terms of extreme-pressure, antiwear, high temperatures, rust protection and water resistance. Ca-sulfonate greases exhibit these superior inherent performance characteristics whereas lithium greases need significant number of additives to match those performance levels.

Overbased calcium sulfonates were reported in 1940's primarily as additives in motor oils for corrosion and oxidation protection. Overbased calcium sulfonates (OBCS) as thickener for greases were reported in 1960's and were essentially prepared in conventional mineral and or synthetic base oils like PAO's. These OBCS greases require over >50% thickener content to get desired consistency, thus lacks in sufficient base oil needed for lubrication. Such reported greases possess low drop point thus limited high temperature application capabilities, poor cold climate flowability and stability issues. Therefore, the properties of these fully formulated greases were inferior to then popular lithium complex greases and also significantly more expensive and thus did not get considerable attention.

In 1985 Muir et al (US No 4,560, 489) disclosed novel process and composition for making overbased calcium sulfonate complex (OBCSC) based grease containing colloidally dispersed calcium carbonate in the form of crystalline calcite, calcium borate and calcium soap of soap-forming aliphatic monocarboxylic acid containing at least 12 carbon atoms exemplified as 12-hydroxystearic acid. The grease compositions disclosed in this invention were prepared either in mineral or in synthetic base oils derived from mineral oil e.g., PAO. The unique composition and process disclosed in this invention resulted in lower thickener content by virtue of complexing, high drop point, extreme pressure, water resistant and rust preventive properties. This triggered the widespread applications of these (OBCSC) greases in the industry specially in high temperature, heavy loads and water borne applications. The performance characteristics of this class of OBCSC greases reported to be superior to most popular lithium complex greases.

In recent past overbased calcium sulfonate base greases have witnessed exponential growth in wide range of application areas (NLGI production survey 2020). The potential reason for the growth of these greases are attributed to the uncertainties in the supply of lithium, an essential component for making lithium greases due to their ever-increasing use in lithium batteries in electronics and for electric vehicles. The increasing cost of lithium has reduced the price parity between lithium complex and calcium sulfonate greases, leading to increasing interest in calcium sulfonate greases. Some recent publications and articles indicate that calcium sulfonate greases could be potential alternate to lithium greases. Previous studies have also found that variations in crystal morphology of grease compositions can have an influence on the tribological performance of the composition, Wang et al., *Friction* 9 (5), (2021).

SUMMARY OF THE INVENTION

High performance Overbased Calcium Sulfonate Complex (OBCSC) grease composition prepared without boric acid and without the use of any alcohol-based promotors, possessing a dispersed portion of crystalline capsule morphology.

An overbased calcium sulfonate complex grease composition that has with extreme-pressure, anti-wear, antioxidant and polymeric additives exhibiting superior performance in extreme pressure and high temperature environments compared to high performance lithium complex and conventional overbased Ca-sulfonate complex greases.

DESCRIPTION OF THE INVENTION

Herein is described overbased an calcium sulfonate complex grease that has been prepared without traditional formation steps utilizing boric acid and/or the use of any alcohol-based promotors thus simplifying the manufacturing process.

According to one embodiment of the invention, this overbased grease is produced by reacting and mixing certain compounds comprising: (a) a primary overbasing material comprising overbased oil-soluble calcium sulfonate having amorphous calcium carbonate dispersed therein; (b) a suitable base oil of an amount appropriate to provide a final acceptable product consistency; (c) in the presence of a functionalized polymer, a stoichiometric excess of finely divided calcium carbonate as an oil-insoluble solid calcium-containing base added to the primary overbasing material and base oil before conversion along; and (d) a doping agent in the form of an extreme-pressure, anti-wear, antioxidant, metal deactivator or polymeric additive, or combination thereof.

Figure 1:
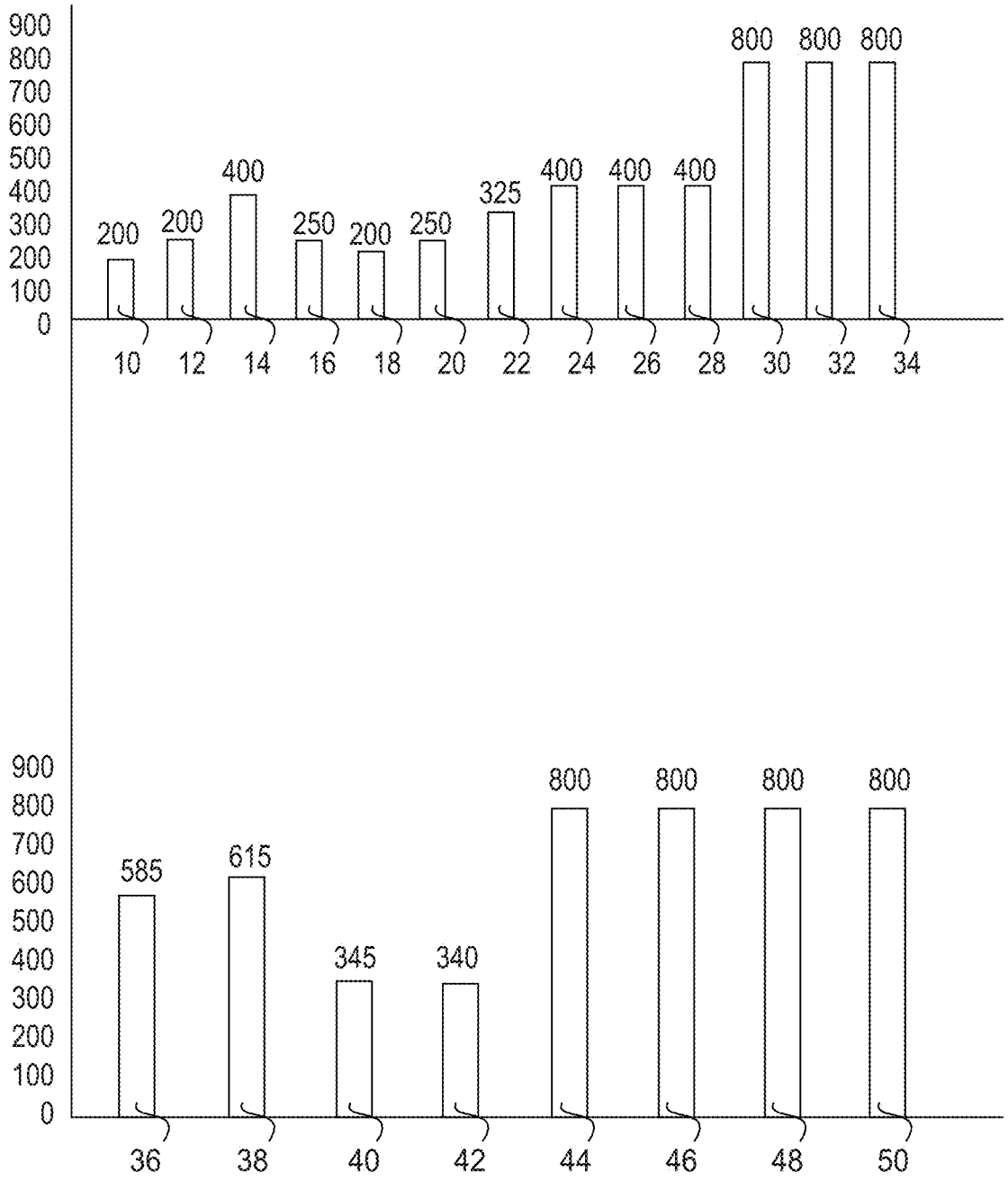
FIG. 1 is a comparative graph of extreme pressure Weld load overbased Ca-sulfonate complex greases with Lithium complex and OBCSC greases described herein.
Figure 2:
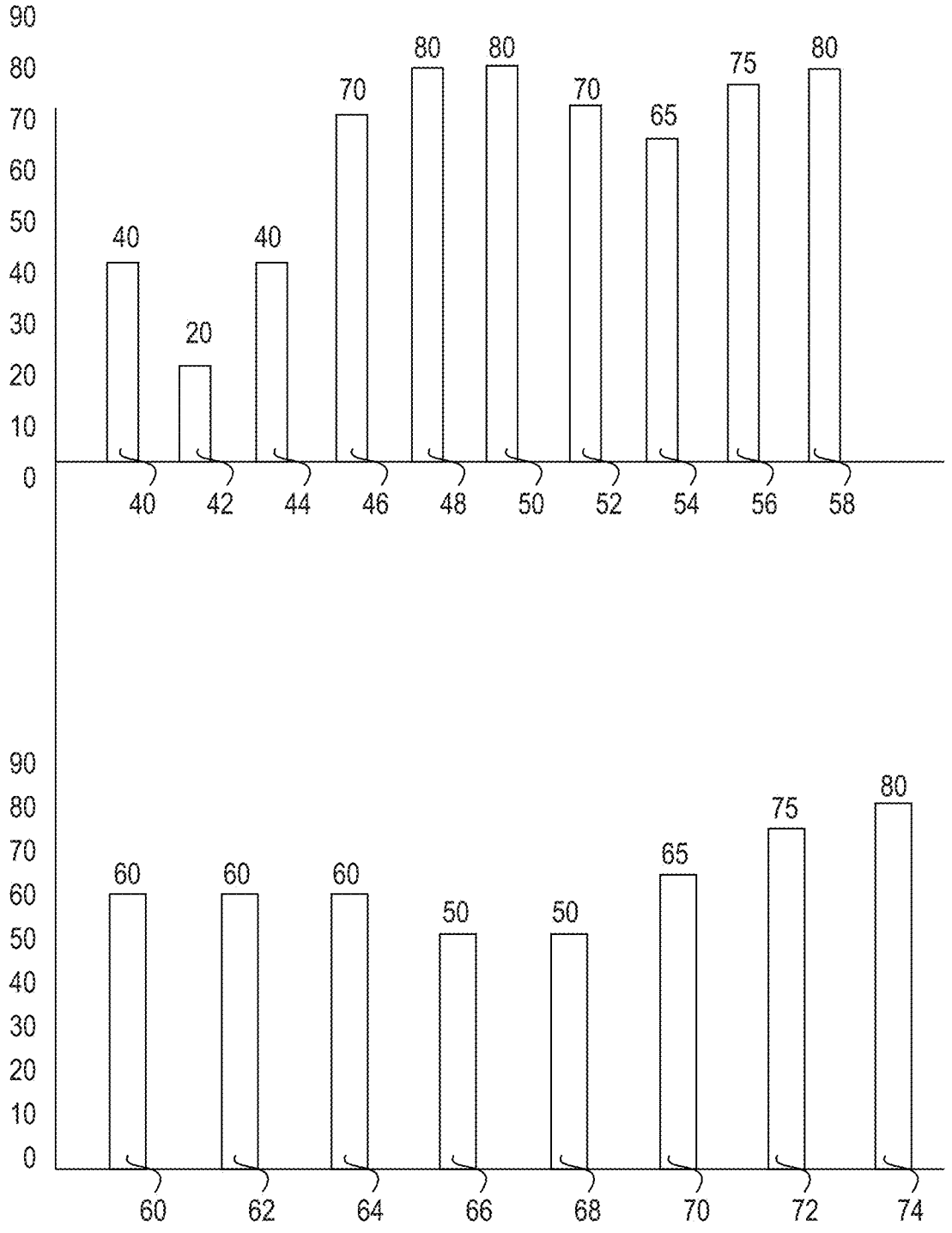
FIG. 2 is a comparative graph of extreme pressure Timken OK Load overbased Ca-sulfonate complex greases with Lithium complex and OBCSC greases described herein.
Figure 3:
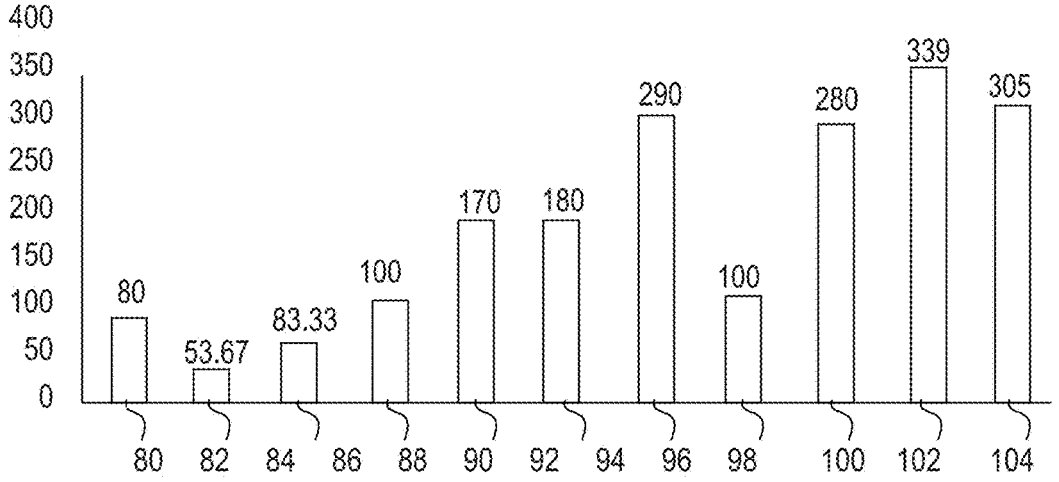
FIG. 3 is a comparative graph of high temperature life of overbased Ca-sulfonate complex greases with Lithium complex and OBCSC greases.
Figure 3:
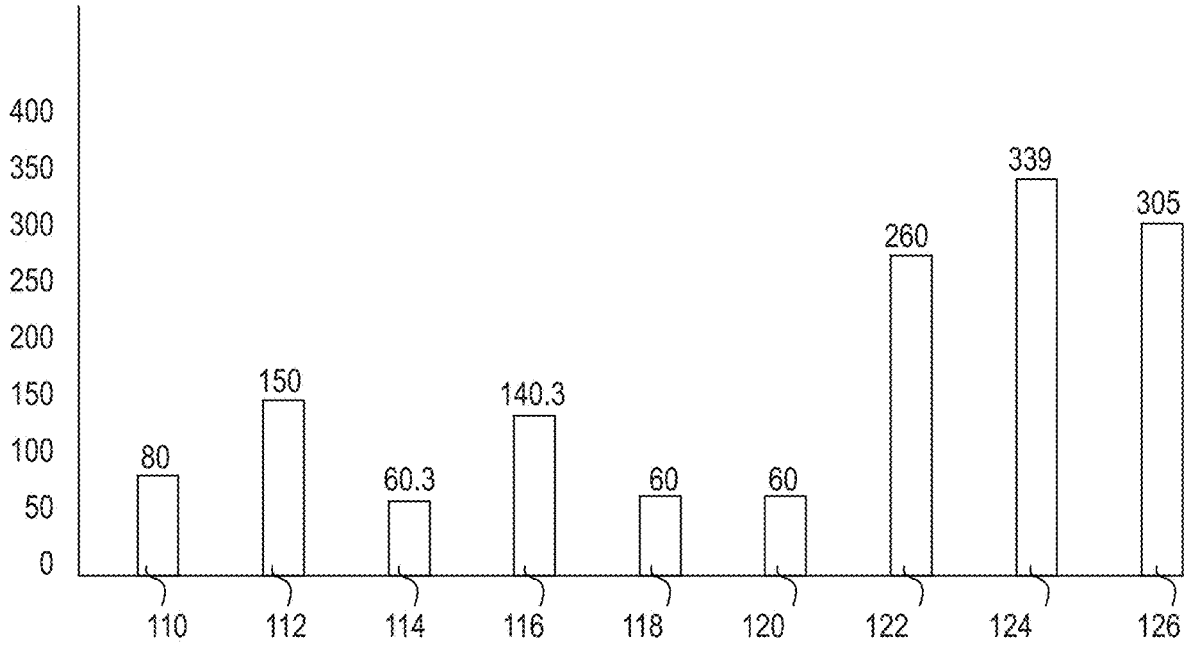
Figure 4:
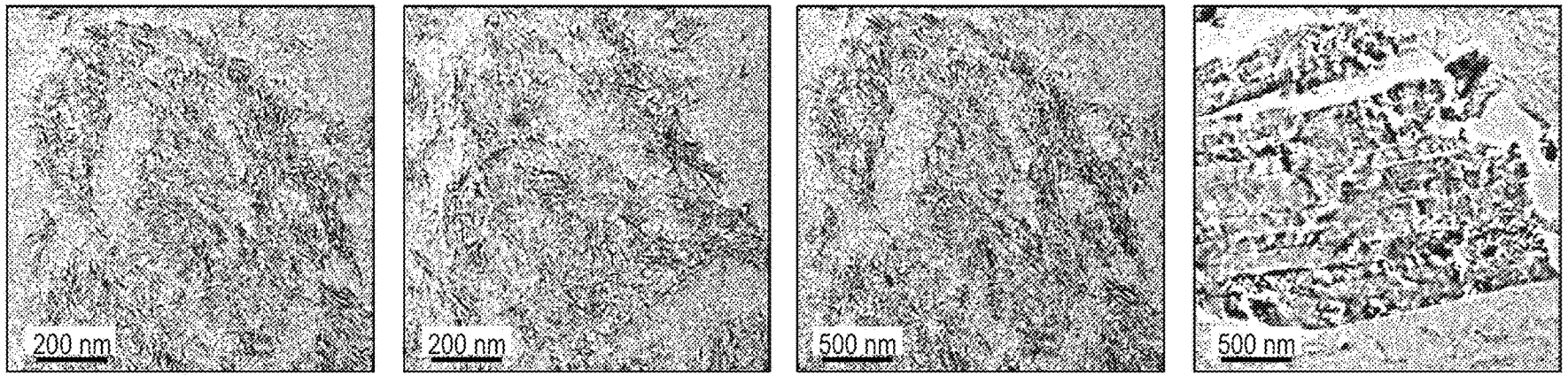
FIG. 4 is a photo of the crystalline capsule morphology of the grease as described herein.
Figure 5:
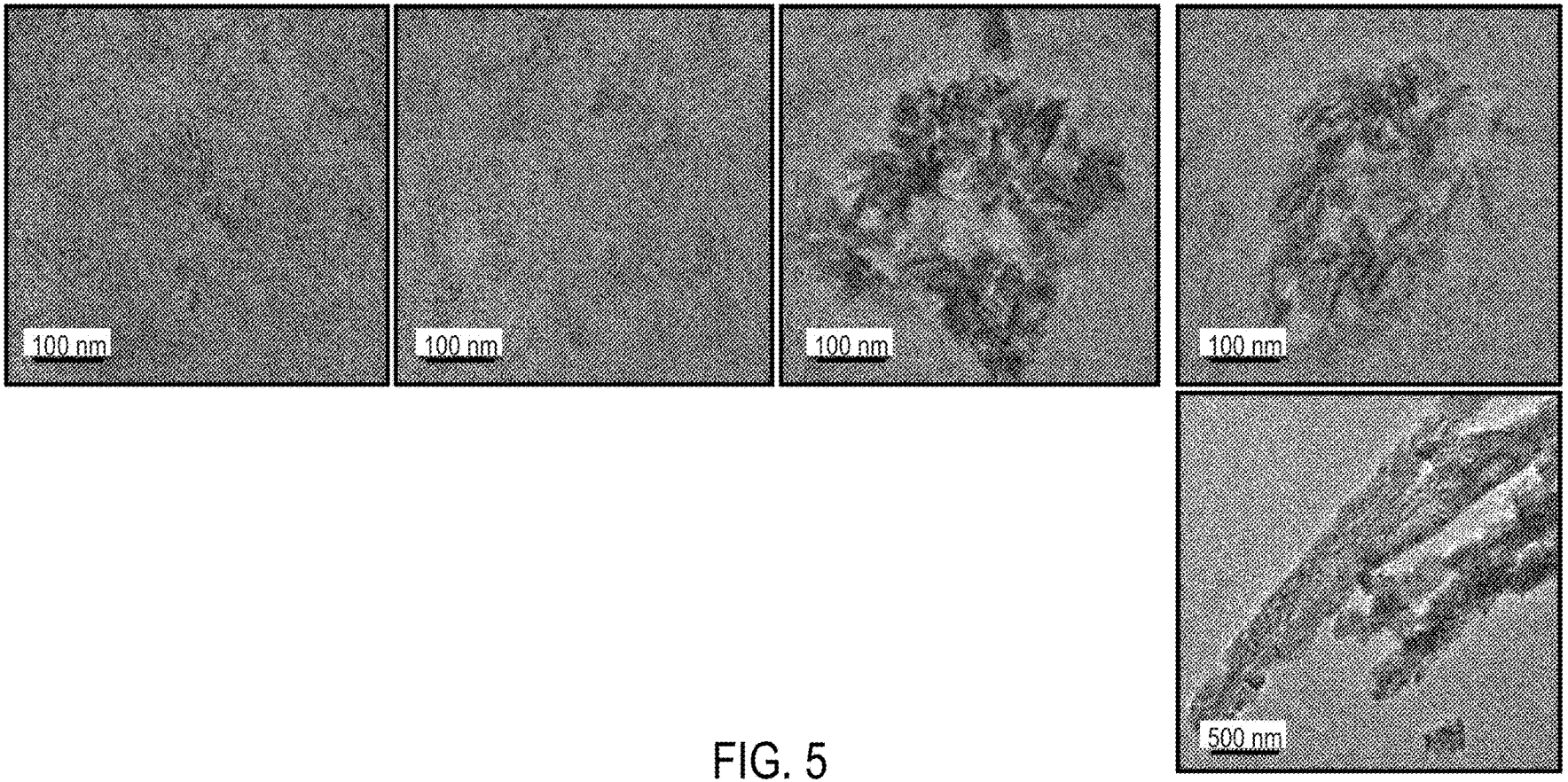
FIG. 5 is a photo of the crystalline needle morphology of a grease within the state of the art.

A further embodiment of the invention is the presence of crystalline, capsular morphologies in the resultant insoluble portion of the grease composition from the method as described herein. The capsule morphology consistent with the invention as described herein has a length of 16.4+/−6.4 nm and a width of 5.7+/−1.3 nm. The presence of the capsule morphologies within the grease composition described herein are distinct and distinguished from the state of the art and have associated beneficial properties in relevant pressure and temperature environments over comparative high performance lithium complex and conventional overbased Ca-sulfonate complex greases, see Table 2 and FIGS. 1-3.

The highly overbased oil-soluble calcium sulfonate used according to an embodiment of the invention can be any typical to that documented in the prior art, such as U.S. Pat. Nos. 4,560,489; 5,126,062; 5,308,514; 5,338,467 and EP 2773590A1. The highly overbased oil-soluble calcium sulfonate may be produced in situ according to such known methods or may be purchased as a commercially available product. Such highly overbased oil-soluble calcium sulfonates will have a Total Base Number (TBN) value not lower than 200, preferably not lower than 300, and most preferably about 400. Commercially available overbased calcium sulfonates of this type include, but are not limited to, the following: Hybase C401 as supplied by Chemtura USA Corporation; Syncal OB 400 and Syncal OB405-WO as supplied by Kimes Technologies International Corporation; Lubrizol 75GR, Lubrizol 75NS, Lubrizol 75P, and Lubrizol 75WO as supplied by Lubrizol Corporation. The amount of the highly overbased oil-soluble calcium sulfonate in the final grease according to this embodiment of the invention can vary but is generally between 10 and 35%. Preferably, the amount of the highly overbased oil-soluble calcium sulfonate in the final grease according to an embodiment of the invention is between 18 and 25%.

Any petroleum-based naphthenic, paraffinic mineral oils or renewable base oils commonly used and well known in the grease making art may be used as the base oil according to the invention. Synthetic base oils may also be used in the greases of the present invention. Such synthetic base oils include but not limited to polyalphaolefins (PAO), diesters, polyol esters, polyethers, alkylated benzenes, alkylated naphthalenes, and silicone fluids. Renewable base oils possessing properties as described in U.S. Pat. No. 11,041,133 herein incorporated by reference are preferred. The total amount of base oil added, including that initially added and any that may be added later in the grease process to achieve the desired consistency, will typically be between 25% and 80%, preferably 35% and 75%, most preferably 40% and 70%, based on the final weight of the grease.

Complexing acids used in this embodiment will comprise no boric acid but will contain at least one long chain carboxylic acid and may comprise a short chain carboxylic acid. The long chain carboxylic acids suitable for use in accordance with the invention comprise aliphatic carboxylic acids with at least 12 carbon atoms. Most preferably, the long chain carboxylic acid is 12-hydroxystearic acid. The amount of long chain carboxylic acid is between 1% and 6%, preferably 1% to 5%, most preferably 2.0% to 3.5%, based on the final weight of the grease.

"Functionalized polymer" as used herein is defined as a polymer which functions to act as binding medium between overbased calcium sulfonate complex thickener and base oil over entire reaction cycle. A functionalized polymer may include but not limited to those described in U.S. Pat. No. 8,563,488, herein incorporated by reference.

The doping agent comprising an oxidation inhibitor, anti-wear additive, metal deactivator, and pressure additive will typically be between 0.5-15% and preferably 5-12% based on the total weight of the grease.

Method of Making the Grease Composition

An embodiment of the invention for making the grease composition with amounts and terminology reflected in Table 1. is described herein. Overbased natural/Synthetic calcium sulfonate is added to a base oil at room temperature with sequential addition of calcium hydroxide, calcium carbonate, water and a functionalized polymer to form an initial mixture. The resulting mixture is heated slowly (<1 deg C./minute) to a temperature of 45-50° C.

An anionic surfactant is added when the mixture reaches the aforementioned temperature range to form a second mixture. The anionic surfactant is preferably selected from the group consisting of a hydrophilic sulfonate head-group and a hydrophobic alkylbenzene tail-group. More preferably, the anionic surfactant is alkyl benzene sulfonic acid. At a temperature less than 65° C., 0.25-3.5% acetic acid is gradually added to the second composition to form a third mixture. After 15-30 minutes of hold time, the temperature of the third mixture is increased to 90±10° C. A full quantity, 1.0-4.5% kg, of 12-hydroxy stearic acid is added to the heated third mixture to form a fourth mixture wherein an additional amount of water is added.

The temperature of the fourth mixture is raised to 160±10° C. with subsequent addition of a hydrogenated styrene isoprene polymer to form a fifth mixture that is mixed for 30-60 minutes at the raised temperature.

The fifth mixture is cooled to a temperature of 110±10° C. by adding a portion of finish base oils to form a sixth mixture, with the sequential addition of remaining calcium carbonate and tricalcium phosphate to form a seventh mixture. Upon formation of the seventh mixture the crystalline capsule morphology as described herein is presented.

The remainder of additives are added to the seventh mixture at a temperature less than or equal to 100° C., wherein the resulting grease composition is milled to a desired specification.

TABLE 1

| Example Grease Composition | | |
|---|---|---|
| Raw Material or Additive | Ca-Sulfonate Complex Composition Preferred Range Weight % | Ca-Sulfonate Complex Composition % Range |
| 400 TBN Overbased natural/ Synthetic calcium sulfonate | 18.00-25.00 | 10.00-35.00 |
| Calcium hydroxide | 1.50-2.50 | 1.00-3.00 |
| Calcium carbonate | 3.00-5.00 | 1.00-10.00 |
| Water | 5.00-7.00 | 3.00-12.00 |
| Functionalized Polymer | 0.20-0.50 | 0.1-1.00 |
| Alkyl Benzene Sulfonic Acid | 2.00-3.50 | 1.00-5.00 |
| Acetic Acid | 0.50-1.00 | 0.25-1.50 |
| 12 Hydroxy stearic acid | 2.00-3.50 | 1.50 5.00 |
| hydrogenated styrene isoprene polymer | 0.50-1.50 | 0.50-2.50 |
| Tricalcium phosphate | 1.50-3.50 | 1.00-5.00 |
| Substituted diarylamine oxidation inhibitor | 0.50-1.50 | 0.50-2.50 |
| Ashless EP and antiwear Additive | 1.50-3.50 | 1.00-5.00 |
| Proprietary Extreme Pressure additive | 1.00-3.00 | 1.00-5.00 |
| MoS2 | 0.0-5.00 | 0.0-5.00 |
| Metal Deactivator | 0.1-0.50 | 0.05-1.00 |
| Base oil (Mineral, renewable, Synthetic and/or blend) | Balance Oil | 40.00-70.00 |

The performance data specially in terms of extreme-pressure, and high temperature have been compared with conventional fully formulated lithium complex EP (extreme pressure) and fully formulated Ca-sulfonate complex greases, Table 2. Comparative data (FIG. 1-3) indicate their superior comparative performance data compared to high performance lithium complex and overbased Ca-sulfonate complex greases indicating potentially synergistic effect of unique combination of composition, additives and process.

TABLE 2

| Comparative Test Data of an OBCSC composition embodiment of the invention with conventional Lithium complex and Ca-sulfonate greases. | | | |
|---|---|---|---|
| | Weld Load (kgs) | Timken OK Load (lbs) | High temperature life (hrs) |
| | Test Method | | |
| Greases | ASTM D2596 | ASTM D2509 | ASTM D3527 |
| NLGI GC-LB | 200 | N/A | 80 |
| NLGI HPM | 250 | N/A | N/A |
| NLGI HPM-High Load | 400 | N/A | N/A |
| Li-com (C) GR-1 | 250 | 40 | 26.67 |
| LI-com (C) GR-2 | 225 | 20 | 53.33 |
| Li-com (C) GR-3 | 250 | 40 | 100 |
| Li-com (I) GR-4 | 325 | 70 | 170 |
| Li-com (I) GR-5 | 400 | 80 | 180 |
| Li-com (I) GR-6 | 400 | 80 | 290 |
| Li-com (I) GR-7 | 400 | 70 | 100 |
| Ca-sulfonate (C) GR-8 | 565 | 60 | 150 |
| Ca-sulfonate (C) GR-9 | 615 | 60 | 60.3 |
| Ca-sulfonate (C) GR-10 | 345 | 60 | 140.3 |
| Ca-sulfonate (C) GR-11 | 340 | 50 | 60 |
| CVX-OBCSC (VG460) | 800 | 65 | 280 |
| CVX-OBCSC (VG460 5% Moly) | 800 | 75 | 339 |
| CVX-OBCSC (VG220) | 800 | 80 | 305 |

The invention claimed is:

1. A method for making a high performance overbased calcium sulfonate complex grease composition prepared without boric acid and without the use of any alcohol-based promotors comprising reacting and mixing (a) a primary overbasing material comprising overbased oil-soluble calcium sulfonate having amorphous calcium carbonate dispersed therein;

(b) a suitable base oil of an amount appropriate to provide a final acceptable product consistency;

(c) in the presence of a functionalized polymer, a stoichiometric excess of finely divided calcium carbonate as an oil-insoluble solid calcium containing base added to the primary overbasing material and base oil before conversion; and (d) a doping agent in the form of an extreme-pressure, anti-wear, antioxidant, metal deactivator or polymeric additive, or combination thereof wherein the mixture is heated at a rate of less than 1° C. per minute to a temperature of 45-50° C.

2. The method of claim 1, further comprising the addition of a carboxylic acid between steps (c) and (d) selected from the group consisting of a long chain aliphatic carboxylic acid with at least 12 carbon atoms.

3. The method of claim 2 wherein the amount of overbased oil-soluble calcium sulfonate is between 10 and 35% by weight.

4. The method of claim 3, wherein the amount of the overbased oil-soluble calcium sulfonate is between 18 and 25% by weight.

5. The method of claim 4, wherein the total amount of base oil added is between 25% and 80% by weight.

6. The method of claim 5, wherein the total amount of base oil added is between 35% and 75% by weight.

7. The method of claim 6, wherein the total amount of base oil added is between 40% and 70% by weight.

8. The method of claim 5, wherein the amount of long chain carboxylic acid is between 1% and 6% by weight.

9. The method of claim 8, wherein the amount of long chain carboxylic acid is between 2.0% and 3.5% by weight.

10. The method of claim 8, wherein the amount of doping agent is between 0.5-15% by weight.

11. The method of claim 10, wherein the amount of doping agent is between 5-12% by weight.

12. The method of claim 10 wherein the resulting grease composition contains an insoluble portion of crystalline capsule morphology.

13. The method of claim 12, wherein the crystalline capsule morphology has a length of about 16.4+/−6.4 nm and a width of about 5.7+/−1.3 nm.

14. The method of claim 1, further comprising increasing the temperature to 90±10° C.; raising the temperature to 160±10° C.; and cooling to 110±10° C.

15. The method of claim 1, further comprising adding an anionic surfactant selected from the group consisting of a hydrophilic sulfonate head-group and a hydrophobic alkylbenzene tail-group.

16. The method of claim 15, wherein the anionic surfactant is alkyl benzene sulfonic acid.

17. The method of claim 12, wherein the grease composition has a weld load of at least 800 kgs according to ASTM D2596.

18. The method of claim 12, wherein the grease composition has a high temperature life greater than 280 hours according to ASTM D3527.

19. A grease composition comprising the reaction product made from components which comprise:

(a) an overbased oil-soluble calcium sulfonate having amorphous calcium carbonate dispersed therein present in an amount of 18-25 weight percent;

(b) a base oil present in an amount of 40-70 weight percent;

(c) a functionalized polymer that acts as a binding medium between the overbased calcium sulfonate and base oil;

(d) a long chain carboxylic acid having at least 12 carbon atoms present in an amount of 2.0-3.5 weight percent;

(e) acetic acid present in an amount of 0.5-1.0 weight percent;

(f) an anionic surfactant comprising a hydrophilic sulfonate head-group and a hydrophobic alkylbenzene tail-group; and (g) a doping agent selected from the group consisting of extreme-pressure additives, anti-wear additives, anti-oxidants, metal deactivators, polymeric additives, and combinations thereof present in an amount of 5-12 weight percent;

wherein the grease composition comprises an insoluble portion having crystalline capsule morphology with a length of 16.4+/−6.4 nm and a width of 5.7+/−1.3 nm, and wherein the grease composition exhibits a weld load of at least 800 kgs according to ASTM D2596 and a high temperature life greater than 280 hours according to ASTM D3527.

* * * * *